US006920843B1

(12) United States Patent
Wilson

(10) Patent No.: US 6,920,843 B1
(45) Date of Patent: Jul. 26, 2005

(54) PROGRAMMABLE WATER HEATER

(76) Inventor: William E. Wilson, 3636 Stage Rd., Ionia, MI (US) 48846

( * ) Notice: Subject to any disclaimer, the term of this patent is extended or adjusted under 35 U.S.C. 154(b) by 0 days.

(21) Appl. No.: 10/658,650

(22) Filed: Sep. 9, 2003

Related U.S. Application Data

(60) Provisional application No. 60/409,214, filed on Sep. 9, 2002.

(51) Int. Cl.[7] ..... F24H 9/20

(52) U.S. Cl. ..... 122/14.1; 122/14.2; 392/463; 392/464

(58) Field of Search ..... 122/13.01, 14.1, 122/14.2, 14.21, 449; 392/463, 464; 126/374.1, 126/351.1

(56) References Cited

U.S. PATENT DOCUMENTS 4,142,515 A * 3/1979 Skaats ..... 122/13.3
5,103,078 A * 4/1992 Boykin et al. ..... 219/494
5,317,670 A * 5/1994 Elia ..... 392/464
6,208,806 B1 * 3/2001 Langford ..... 392/464
6,375,087 B1 4/2002 Day et al.
6,445,880 B1 * 9/2002 Hollander et al. ..... 392/485
6,588,377 B1 * 7/2003 Leary et al. ..... 122/19.1
6,701,874 B1 * 3/2004 Schultz et al. ..... 122/14.2

* cited by examiner

*Primary Examiner*—Gregory Wilson
(74) *Attorney, Agent, or Firm*—Young & Basile, P.C.

(57) ABSTRACT

An apparatus for programmably controlling the operation of a water heater having a programmable timer coupled to the water heater for establishing predetermined times of when the water heater should operate. The programmable controller allows for the operation of a solenoid valve which controls the flow of natural gas to a burner. The present invention may utilize a conventional 110/120 volt power source as provided in a power vented gas water heater or an electrical water heater, or the present invention may utilize a thermopile as a mini generator by which to power the programmable timer and solenoid.

9 Claims, 3 Drawing Sheets

PROGRAMMABLE WATER HEATER

This is a formalization of U.S. Provisional Patent Application Ser. No. 60/409,214 filed Sep. 9, 2002.

FIELD OF THE INVENTION

The present invention relates to water heaters, and more particularly, an apparatus for programmably controlling a water heater to provide more efficient use thereof.

BACKGROUND OF THE INVENTION

Typically, hot water heaters heat water through the use of either electricity or natural gas. The hot water heater provides a thermostat wherein the temperature of the water within the hot water heater is maintained at a predetermined temperature established by the thermostat. When the water within the hot water heater reaches a temperature below the predetermined temperature set by the thermostat, the hot water heater begins to heat the water within the hot water heater until the water reaches the predetermined set temperature.

The reheating of the water within the hot water heater is inherently an inefficient process because the water within the hot water heater is maintained at a predetermined temperature even when the water within the hot water heater is not ready to be used. This situation has continued in the industry because most consumers do not know at what point they will or will not need hot water. In addition, consumers are typically not willing to wait the necessary length of time for a hot water heater to heat a full tank of cold water. Thus, many consumers are willing to live with the inefficient process of a hot water heater in order to have hot water on demand.

However, there are times in which a consumer does know in advance that they will not need hot water. For instance, vacations, work schedules, nighttime and other events allow consumers to know that they will not be needing hot water during those time periods. Therefore, it would be a more efficient process if the hot water heater was turned off during those periods in which hot water was not required.

It would be desirable to provide a programmable hot water heater that would allow for the turning on and off of a water heater based on a consumer's demand schedule.

SUMMARY OF THE INVENTION

The present invention solves the above-noted shortcomings by providing an apparatus for programmably controlling the operation of a water heater. The apparatus of the present invention provides a programmable timer coupled to a water heater for establishing predetermined times of when the water heater should be engaged and disengaged. The present invention also provides a means, coupled to the water heater, for disengaging and engaging the water heater in response to the programmable controller. In addition, the apparatus of the present invention provides a means for powering the programmable timer and the disengaging means in order to properly operate the apparatus of the present invention.

BRIEF DESCRIPTION OF THE DRAWINGS

The description herein makes reference to the accompanying drawings, wherein like reference numerals refer to like parts throughout several views and wherein.

DETAILED DESCRIPTION OF THE PRESENT INVENTION

Figure 1:
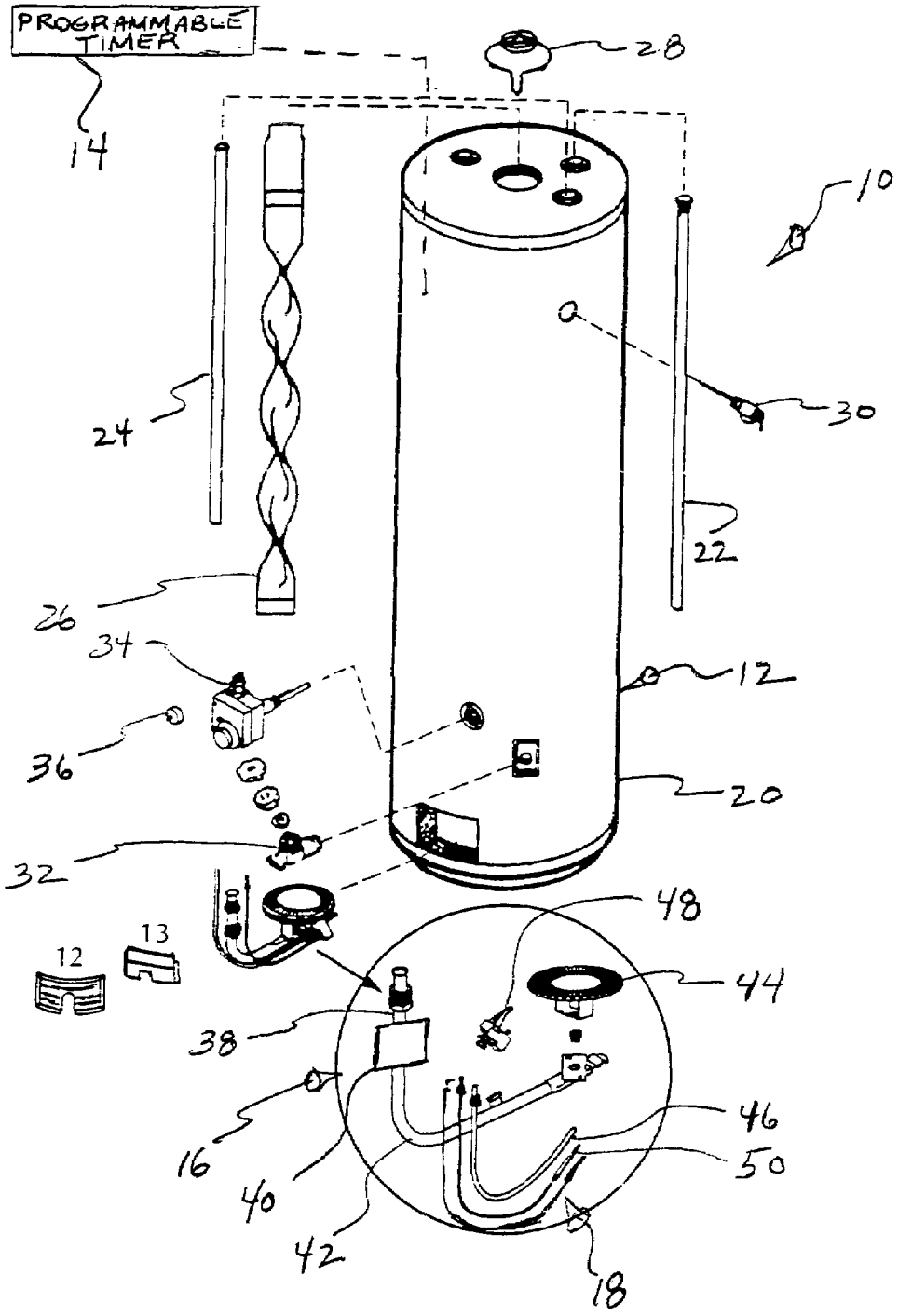
FIG. 1 is an exploded view showing the apparatus of the present invention being utilized on a standing pilot gas water heater.

Referring to the drawings, the present invention will now be described in detail with reference to the preferred embodiment.

Figure 2:
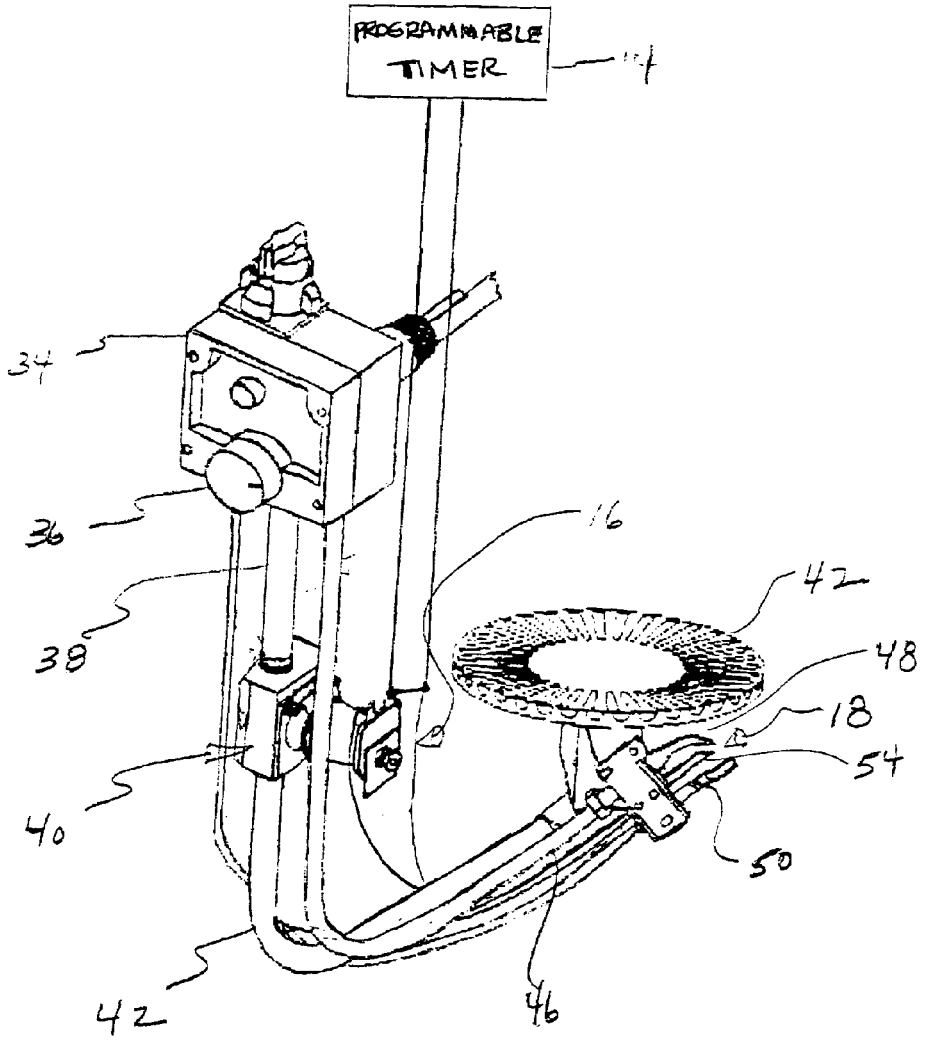
FIG. 2 is a perspective view further showing the present invention used on a standing pilot gas water heater.
Figure 3:
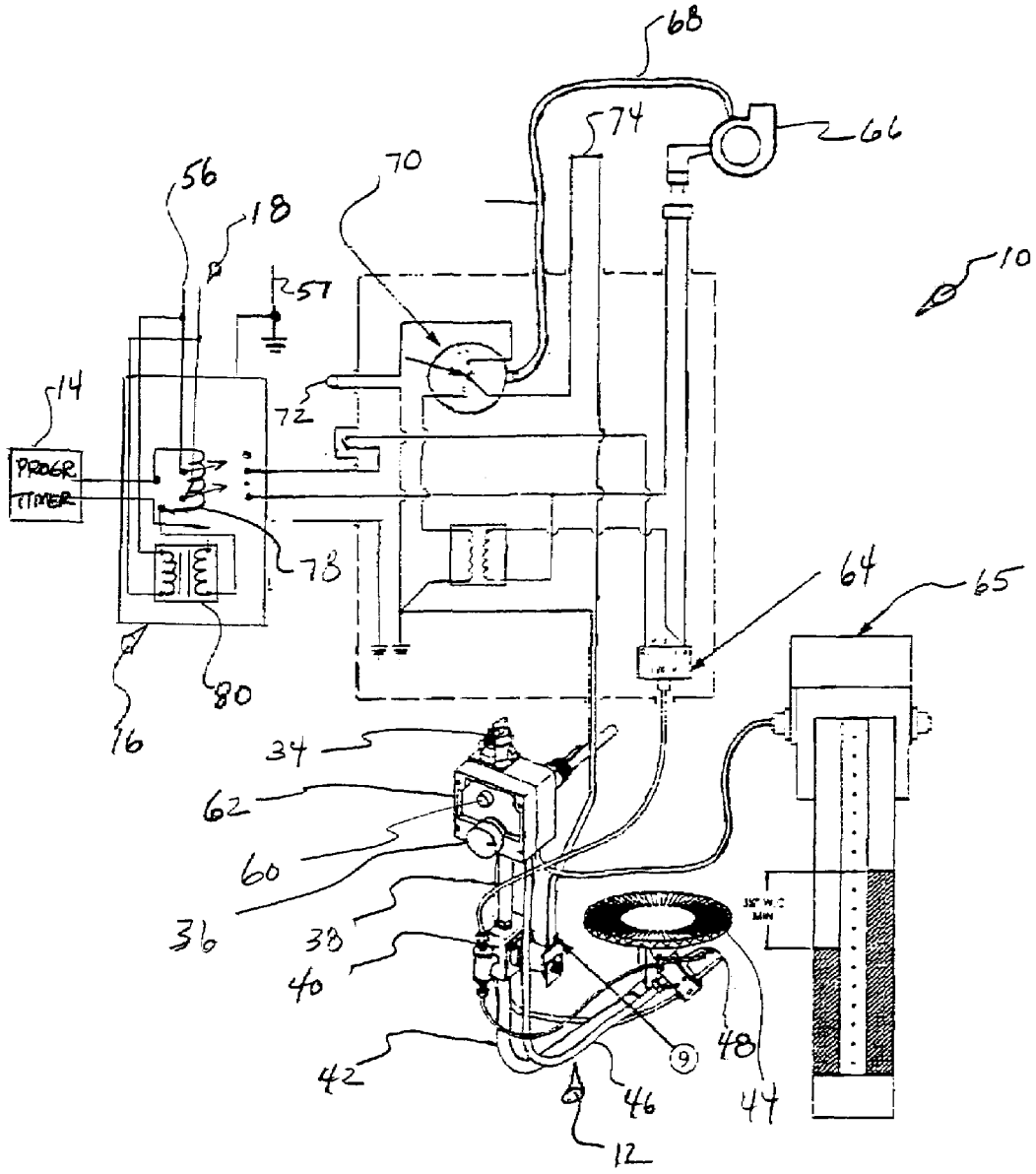
FIG. 3 is a schematic diagram showing the present invention utilized on a power vented gas water heater.

FIGS. 1–3 depict an apparatus 10 for programmably controlling the operation of a water heater 12, as shown in the present invention. The apparatus 10 provides a programmable timer 14 which actuates a means for disengaging 16 the water heater 12 in response to the programmable timer 14. The programmable timer 14 may be mounted on the water heater 12 directly or it may be mounted on a wall of the home or building in which the water heater is housed. The present invention also provides a means for powering 18 the programmable timer 14 and the disengaging means 16 in order to programmably control the apparatus 10.

The apparatus 10 of the present invention may be utilized on any type of conventional water heater 12. FIGS. 1 and 2 show a gas water heater 12 having a standing pilot. The water heater 12 provides a tank 20 having a primary anode rod 22, a dip tube 24, and a flue baffle 26 which are all located within the tank 20. The water heater 12 also provides a draft hood 28 at the top of the tank 20 and a temperature-pressure relief valve 30 in the side of the tank 20. A drain valve 32 is provided in the side of the tank 20 in order to drain the water from the tank 20 if necessary.

In order to heat the water within the water heater 12, natural gas is burned by the water heater 12. A gas control valve 34 controls the flow of natural gas to the water heater 12, and a temperature adjustment knob 36 maintains the water within the water heater 12 at a predetermined temperature. An upper manifold 38 extends from the gas control valve 34 to a solenoid 40. A lower manifold 42 is connected to the solenoid 40 and communicates with a burner 44. The upper and lower manifolds 38, 42 direct natural gas to the burner 44 so that the burner 44 may burn the natural gas and heat the water within the water tank 12. The solenoid 40 actuates a valve (not shown) allowing the natural gas to flow from the upper manifold 38 to the lower manifold 42. A pilot tube 46 is also connected to and extends from the gas control valve 34 and provides a small stream of natural gas to a pilot 48. A burning element 50 is provided adjacent the pilot 48 such that the pilot 48 burns the burning element 50, thereby maintaining the flame on the pilot 48.

As seen in FIG. 2, the programmable timer 14 of the present invention may be programmed by entering the days and times in which the user wishes to engage and disengage the hot water heater 12. The programmable controller 14 is electrically connected to the solenoid 40, and a thermopile 54 acts as a millivolt generator to provide power to the circuitry of the programmable controller 14. The thermopile 54 allows the apparatus 10 to operate without the need of an external power source. This is advantageous with the water heater 12 disclosed in FIGS. 1 and 2 since a gas hot water heater with a standing pilot does not typically have electrical power leading to or from the water heater 12. In addition, the thermopile 54 works as a safety device because if the pilot 48 is extinguished, the thermopile 54 does not generate power thereby automatically disengaging the solenoid 40. With the solenoid 40 disengaged, natural gas cannot be fed to the burner 44.

The present invention may also be utilized with a power vented gas water heater 12, as seen in FIG. 3, or the present invention may be utilized with electrical water heaters (not shown). The main difference with the apparatus 10 when used on power vented gas water heaters and electrical water heaters is that such water heaters 12 have power leading to the water heaters 12 for the operation thereof. Therefore, instead of using thermopile 54, the present invention simply uses the power provided to the water heater 12. The circuitry of the power vented gas water heater 12 is connected to a 110/120 volt power supply 56 with the water heater 12 being securely and adequately grounded by ground 57. An on/off toggle switch 60 is provided on a control box 62 below the gas control valve 34 to allow the circuit to operate the water heater 12. The power vented gas water heater 12 provides a similar tank 20 (not shown in FIG. 3) and burner assembly as shown in FIGS. 1 and 2. As seen in FIG. 3, the gas control valve 34 has the temperature adjustment knob 36 on the control box 62. The gas control valve 34 also has an on/off switch whereby the gas control valve 34 must be in the "on" position to allow gas to flow through the gas control valve 34. The upper manifold 38 extends from the gas control valve 34 and is connected to the solenoid 40. The lower manifold 42 extends from the solenoid 40 and communicates natural gas to the burner 44. The pilot tube 46 extends from the gas control valve 34 and communicates natural gas to the pilot 48 wherein a stream of natural gas is lit to maintain a flame from the pilot 48.

The power vented gas water heater 12 also provides a gas pressure switch 64 and a gas pressure meter 65 to monitor an initial flow of natural gas provided by the water heater 12 when the thermostat calls for heat. When the gas pressure switch 64 senses natural gas, it closes an electrical circuit provided to the blower 66. The blower 66 provides pressurized air through an air line 68 which communicates with an air pressure switch 70. An indicator light 72 is actuated upon the actuation of the blower 66. When the blower 66 has provided sufficient venting, the air pressure switch 70 closes, and the indicator light 72 turns off. When sufficient venting occurs, the air pressure switch 70 closes a circuit through a venting manual reset switch 74 and the gas control valve 34. The gas control valve 34 opens and allows gas to flow to the burner 44.

The programmable timer 14 overrides the circuitry in the power vented water heater 12 to disengage and engage the water heater 12 at predetermined intervals. The programmable controller 14 is electrically connected to a 24 volt contactor 78 which is connected to the 110/120 volt power supply 56. A 24 volt transformer 80 is connected to the contactor 78 to provide power to the coil of the contactor 78. The contactor 78 and the transformer 80 are properly ground by ground 57. The contactor 78 provides a switch wherein power is allowed to flow to the circuitry of the power vented hot water heater 12 when the switch is closed, and power is not allowed to flow to the circuitry of the power vented hot water 12 when the switch is open, thereby disengaging and disabling the power vented hot water 12. The programmable timer 14 may be programmed by entering the days and the times in which a user desires to have the hot water heater 12 on and off.

In operation, an operator programs the programmable timer 76 to turn off or disengage the hot water heater 12 during predetermined intervals. When the programmable controller 76 disengages the hot water heater 12 in response to its program, the programmable timer 76 opens the circuitry of the water heater 12 to prevent the operation of the water heater 12. When the programmable timer 76 engages or turns on the hot water heater 12, the programmable timer 76 closes the circuitry of the hot water heater 12 thereby allowing the water heater 12 to function in a normal manner.

While the invention has been described in connection with what is presently considered to be the most practical and preferred embodiment, it is to be understood that the invention is not to be limited to the disclosed embodiments, but on the contrary, it is intended to cover various modifications and equivalent arrangements, included within the spirit and scope of the appended claims, the scope is to be accorded the broadest interpretations so as to account for all such modifications and equivalent structures as is permitted under the law.

What is claimed is:

1. An apparatus for controlling the operation of a water heater, comprising:

control means, communicatable with said water heater, for engaging and disengaging said water heater;

a programmable timer coupled to said control means for establishing when said control means will engage and disengage said water heater; and a thermopile coupled to said programmable timer and said control means, and said thermopile acting as a millivolt generator to provide power to said programmable timer and said control means.

2. The apparatus stated in claim 1, said control means further comprising:

a solenoid communicatable with a fuel source, and said solenoid actuatable in response to said programmable timer to control the flow of fuel from said fuel source to said water heater.

3. The apparatus stated in claim 1, said control means further comprising:

an electrical circuit coupled to said programmable timer wherein said electrical circuit opens and closes in response to said programmable timer to control the operation of said water heater.

4. An apparatus for programmably controlling the operation of a water heater, comprising:

an actuator adaptable to actuate and de-actuate said water heater; and a programmable timer coupled to said actuator for establishing when said actuator actuates and de-actuates said water heater;

a thermopile coupled to said programmable timer and said actuator, and said thermopile acting as a millivolt generator to provide power to said actuator and said programmable timer.

5. The apparatus stated in claim 4, wherein said actuator further comprises:

a solenoid communicatable with a fuel source, and said solenoid actuatable in response to said programmable timer to control the flow of fuel from said fuel source to said water heater.

6. The apparatus stated in claim 4, said actuator further comprising:

an electrical circuit coupled to said programmable timer wherein said electrical circuit opens and closes in response to said programmable timer to control the operation of said water heater.

7. An improved apparatus for controlling the operation of a water heater, wherein said water heater has a holding tank for holding water, a heating source for heating said water in said holding tank, and a fuel supply for supplying said heating source, the improvements comprising:

an actuator for controlling the supply of said fuel to said heating source;

a programmable timer coupled to said actuator for actuating and de-actuating said actuator; and a thermopile coupled to said programmable timer and said actuator, and said thermopile acting as a millivolt generator to provide power to said actuator and said programmable timer.

8. The improved apparatus stated in claim 7, further comprising:

said actuator having a solenoid communicatable with the fuel supply and actuating in response to said programmable controller to control the flow of fuel from said fuel supply to said heating source.

9. The improved apparatus stated in claim 7, further comprising:

said actuator having an electrical circuit coupled to said programmable timer wherein said electrical circuit opens and closes in response to said programmable timer to control the operation of said water heater.

* * * * *